US007363739B2

(12) United States Patent
Dalsey et al.

(10) Patent No.: US 7,363,739 B2
(45) Date of Patent: Apr. 29, 2008

(54) DISPLAY OF PICTURES IN DECORATIVE SETTINGS

(76) Inventors: Crystal A. Dalsey, 891 E. Warner Rd., Suite 100, Gilbert, AZ (US) 85296; Edward M. Dalsey, 891 E. Warner Rd., Suite 100, Gilbert, AZ (US) 85296

( * ) Notice: Subject to any disclaimer, the term of this patent is extended or adjusted under 35 U.S.C. 154(b) by 336 days.

(21) Appl. No.: 11/063,800

(22) Filed: Feb. 22, 2005

(65) Prior Publication Data

US 2006/0185211 A1 Aug. 24, 2006

(51) Int. Cl.
*A47G 1/06* (2006.01)

(52) U.S. Cl. ..... 40/729; 40/776; 40/798

(58) Field of Classification Search ..... 40/729, 40/730, 765, 799, 775, 776, 735, 798
See application file for complete search history.

(56) References Cited

U.S. PATENT DOCUMENTS

| | | | | | |
|---|---|---|---|---|---|
| 3,339,302 | A * | 9/1967 | Mallory | 40/729 |
| 3,673,724 | A * | 7/1972 | Bell et al. | 40/729 |
| 4,115,938 | A * | 9/1978 | Belmuth et al. | 40/730 |
| 4,250,640 | A * | 2/1981 | Culhane | 40/776 |
| 4,286,400 | A * | 9/1981 | MacPherson et al. | 40/799 |
| 4,432,152 | A | 2/1984 | Daenen | |
| 4,608,770 | A | 9/1986 | Gray | |
| 4,712,322 | A * | 12/1987 | Rubin | 40/730 |
| 4,827,639 | A * | 5/1989 | Wang | 40/730 |
| 4,897,944 | A * | 2/1990 | Otake et al. | 40/704 |
| 4,934,078 | A * | 6/1990 | Sloot | 40/754 |
| 4,934,739 | A * | 6/1990 | Stancato | 281/38 |
| 5,588,240 | A * | 12/1996 | Zilliox | 40/729 |
| 5,713,148 | A * | 2/1998 | Lovison | 40/776 |
| 5,904,373 | A * | 5/1999 | Krapf | 281/29 |
| 5,906,349 | A | 5/1999 | Roy | |
| 6,273,979 | B1 | 8/2001 | Lastoria | |
| 6,338,215 | B1 * | 1/2002 | Vincent | 40/730 |
| 6,347,467 | B1 * | 2/2002 | Meyer | 40/124.06 |
| 6,651,948 | B2 | 11/2003 | Szarata | |
| 6,658,778 | B2 | 12/2003 | Roy | |
| 6,684,545 | B2 | 2/2004 | Wohlleb | |
| 2005/0193613 | A1 * | 9/2005 | Faltesek | 40/711 |
| 2006/0162213 | A1 * | 7/2006 | Einarson | 40/765 |
| 2006/0201039 | A1 * | 9/2006 | Gilliland | 40/605 |
| 2007/0084100 | A1 * | 4/2007 | DeLong | 40/776 |

* cited by examiner

*Primary Examiner*—William L. Miller
(74) *Attorney, Agent, or Firm*—Robert D. Atkins; Quarles & Brady LLP

(57) ABSTRACT

A decorative border affixed to a solid surface which includes a plurality of photographic display units extending in physical commonality to form the decorative border, each of the plurality of photographic display units having a pocket surrounded by a decorative surface area, and an attachment mechanism for mounting the plurality of display units to the solid surface is disclosed. A decorative border including a plurality of photographic units embodied in a flexible sheet of underlayment, covering and optional decorative surface sheet is also disclosed. A decorative border including a plurality of interconnected photographic display units coupled together by a connecting mechanism which form the decorative border is also disclosed. Finally, a method of making a decorative border which includes providing the same is disclosed.

11 Claims, 6 Drawing Sheets

DISPLAY OF PICTURES IN DECORATIVE SETTINGS

FIELD OF THE INVENTION

The present invention relates in general to structures for supporting and displaying artwork, graphics and photographs and, more particularly, to a decorative border structure for supporting and displaying the same.

BACKGROUND OF THE INVENTION

Many picture frames currently available in the marketplace allow for the creation of a picture collage. Typically, however, picture frames are inflexible due to a predetermined number and arrangement of pictures. Moreover, these frames do not allow for the formation of a decorative border which includes a plurality of frames.

In most cases, photographs, artwork and other graphical memorabilia sit in a drawer once the photographs are viewed for the first time. It is generally neither economically feasible nor aesthetically pleasing to display the many photographs and other images that often collect in the average home. For example, scores of picture frames would be necessary to display the average household's collection of photographs. Too many picture frames, in turn, clutter walls and living spaces.

For example, many photographers opt to develop a roll of film to obtain a number of 4×6 inch prints from a local photo lab. These prints are collectively viewed once or twice, perhaps among friends, and then stored away. Often, these pictures chronicle the day-to-day events of the subjects, but are not displayed. To display even a portion of these prints, a photographer generally would have to spend the time obtaining a large number of frames, and then additional time individually inserting each print into each frame and hanging each individual frame. Moreover, the large number of holes created as a result creates excessive damage to walls and other structures.

The time required to display an average collection of photographs, in and of itself, can be discouraging. Moreover, once the prints are inserted and hung, it is unlikely that a user will desire to change the display, partly due to the extra time and effort involved.

As a result, a need exists for a display mechanism to accommodate a number of pictures, graphics or other artwork. In addition, a need exists for a support and display structure for artwork, graphics and photographs which encourages display and eliminates the problem of displaying and re-displaying a large number of prints in a time-efficient and economically feasible manner.

SUMMARY OF THE INVENTION

In one embodiment, the present invention is a decorative border affixed to a solid surface, comprising a plurality of photographic display units extending in physical commonality to form the decorative border, wherein each of the plurality of the photographic display units has a pocket which is surrounded by a decorative surface area.

In another embodiment, the present invention is a decorative border affixed to a solid surface, comprising a first display unit adapted for receiving a first image, a second display unit adapted for receiving a second image, a connector which couples the first display unit to the second display unit to form the decorative border, and an attachment mechanism integrated in the decorative border for mounting the decorative border to the solid surface.

In another embodiment, the present invention is a decorative border affixed to a solid surface, comprising a flexible sheet of underlayment, a flexible sheet of covering disposed over the flexible sheet of underlayment forming a plurality of photographic display pockets, and an attachment mechanism for mounting the decorative border to the solid surface.

In another embodiment, the present invention is a method of manufacturing a decorative border affixed to a solid surface, comprising providing a plurality of photographic display units extending in physical commonality to form the decorative border, wherein each of the plurality of photographic display units has a pocket which is surrounded by a decorative surface area and providing an attachment mechanism for mounting the plurality of photographic display units to the solid surface.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
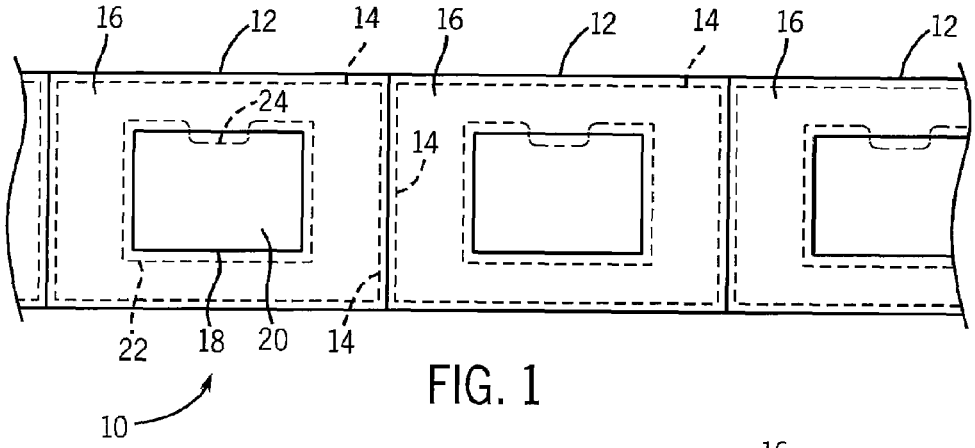
FIG. 1 illustrates a top-view of a decorative border for displaying pictures, images, artwork or other representations.

Turning to FIG. 1, a decorative border is seen in one example. Decorative border 10 includes a number of photographic display units 12 which are joined together in some fashion. Border 10 can include individual display units 12 which are coupled by a connecting mechanism 14. Connecting mechanism 14 can include a variety of means for an individual display unit 12 to attach to, or otherwise be secured to another individual display unit 12. Some examples of connecting mechanism 14 will be discussed below. In addition to including a number of individual display units 12 which are connected together, border 10 can also include individual display units 12 which are seamlessly connected.

Display units 12 can include the same kinds of materials which can be incorporated into an ordinary picture frame, such as glass, wood, plastics, metals, fabrics and other materials. Display units 12 can include a backing material, a framework for structural support and a covering for protection, again similar to features of an ordinary picture frame.

In the example shown in FIG. 1, border 10 includes a number of individual display units 12 which are coupled together to form the decorative border. Display units 12 are joined together with connecting mechanism 14. Display unit 12 can have a connecting mechanism 14 on each end of display unit 12, and top and bottom of display unit 12. Connecting mechanisms 14, located on each side of display unit 12, allow for flexibility in creating border 10. For example, a user can create a variety of shapes using individual display units 12. A user can follow the contour of a surface, laying out and constructing a border to follow an irregularly shaped wall by stacking a first display unit 12 on top of a second display unit 12 or by securing a second display unit 12 adjacent to a first display unit 12. A user can, in effect, "build" a decorative border to accommodate a particular surface or create a particular design using an appropriate combination of interconnected display units 12. Several examples of decorative border designs and layouts utilizing coupled individual display units 12 will be described below.

Border 10 includes a decorative surface area 16 with an associated opening 18 for displaying an image 20. Surface area 16 can also include standard materials which are used in an ordinary picture frame, such as matting and frame materials. Surface area 16 can include materials such as glass, wood, metals, plastics, fabrics, or a combination of materials.

Display unit 12 has an associated pocket 22 which is adapted for receiving a graphical image, artwork, photograph or other representation. Pocket 22 can be formed using a variety of means. For example, pocket 22 can include a cut-out of a piece of display unit 12 that is removable and similar in design to the cutout features of an ordinary picture frame. Pocket 22 can have an associated tab 24 which allows a user to grasp and remove an image or other representation from pocket 22 without having to remove a piece of backing material.

Figure 2:
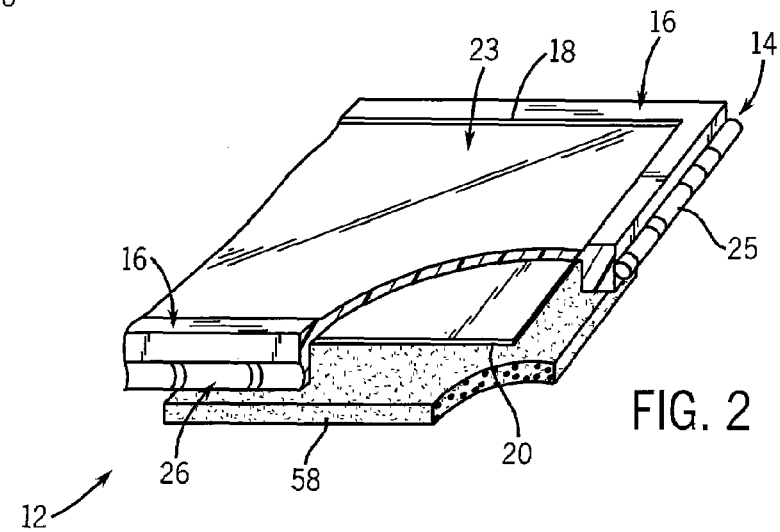
FIG. 2 illustrates a cut-away view of a photographic display unit for building a decorative border.

Turning to FIG. 2, an individual photographic display unit 12 is shown in cut-away form. Display unit 12 is shown including connecting mechanism 14, surface area 16, opening 18, and image 20. Image 20 is protected by a clear covering 23. Covering 23 can include materials such as glass or plastic, or similar material suitable to display and protect image 20. Covering 23 can also include elements to provide additional ornamentation to image 20. Covering 23 can have properties which are intended to enhance or change a feature or quality of an image 20, such as blurring or additional color embedded in covering 23.

Connecting mechanism 14 as shown in FIG. 2 includes a tongue 25 and groove 26 mechanism. Mechanism 14 allows for two or more individual display units 12 to be connected or coupled securely together. For example, display unit 12 can include a male-type mechanism on one side of display unit 12, and a female-type mechanism on an opposite side of display unit 12.

Mechanism 14 can include such mechanisms as a spring clip, a snap-together mechanism, an adhesive mechanism, or a removable and re-attachable mechanism such as Velcro. Mechanism 14 can have associated projections to allow mechanism 14 to connect two individual display units 12 together, such as dowels or biscuits which slide into receiving slots or holes of display units 12. Mechanism 14, again, can include any connecting apparatus known in the art for joining two pieces of material securely together.

Figure 3:
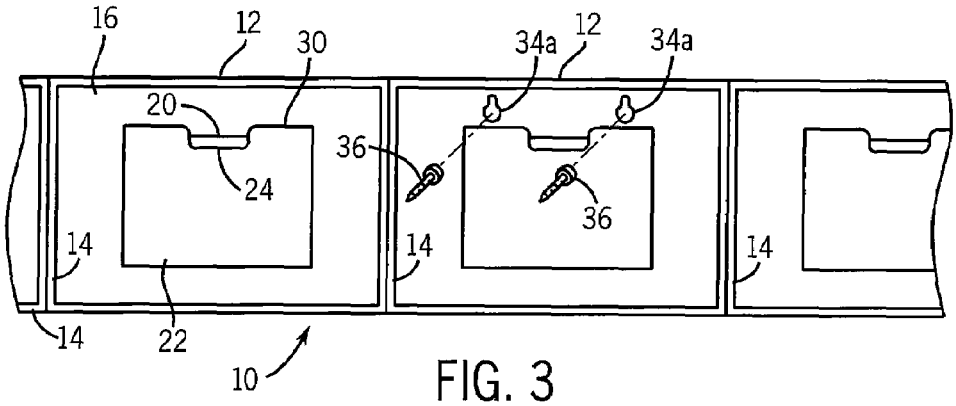
FIG. 3 illustrates a bottom-view of a decorative border.

Turning to FIG. 3, border 10 as shown in FIG. 1 is shown in a bottom-view. Again, individual display units 12 are shown coupled together using connecting mechanisms 14. Decorative surface area 16 is again shown surrounding pocket 22 with associated tab 24. An image 20 can be slid into an opening 30 formed between pocket 22 and area 16.

Border 10 includes an attachment mechanism 34*a*, 34*b*, or 34*c* which allows border 10 to be mounted to a surface. In the depicted example, attachment mechanism 34*a* has a slot which is adapted to receive the head of a screw 36. Screw 36 is installed in the surface, with the head of screw 36 protruding from the surface. Display unit 12 can be then hung on screws 36, and adjacent display units 12 can be coupled using connecting mechanisms 14. As an alternative, display units 12 can be pre-connected by connecting mechanisms 14 into the desired decorative border 10. Border 10 can then be hung on screws 36. Border 10 can have as many attachment mechanisms 34*a*, 34*b*, or 34*c* as necessary to support the weight of border 10. In one example, attachment mechanisms 34*a*, 34*b*, or 34*c* can be located on every nine or ten individual display units 12.

Having a limited number of attachment mechanisms 34*a*, 34*b*, or 34*c* associated with a particular border 10 is a substantial improvement over the traditional necessity to create a hole in a surface to display each of a plurality of individual units in a decorative setting. By limiting the number of attachment mechanisms 34*a*, 34*b*, or 34*c*, a user can avoid the prospect of creating excessive damage to a surface when displaying a plurality of individual display units 12 which are interconnected to form border 10.

Mechanism 34*a*, 34*b*, or 34*c* can include any known mechanism for securing border 10 to the desired surface. In some cases, mechanism 34*a*, 34*b*, or 34*c* can be an adhesive. Mechanism 34*a*, 34*b*, or 34*c* can include a removable and/or re-attachable apparatus, such as velcro or other similar material.

Figure 4A:
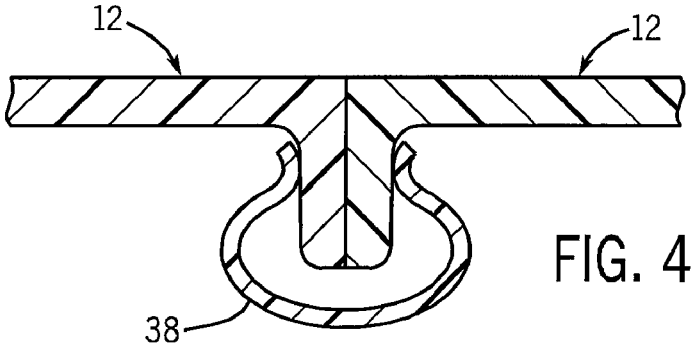
FIGS. 4*a*-4*d* illustrate connecting mechanisms for joining photographic display units to construct a decorative border.
Figure 4B:
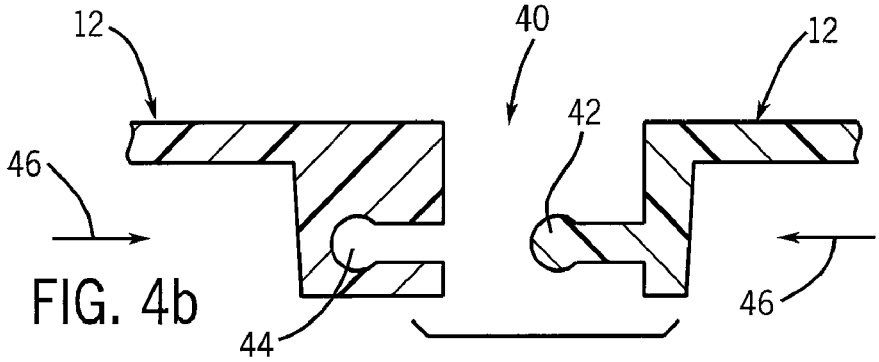

As previously mentioned, a variety of mechanisms 14 can be used to connect an individual display unit 12 with another individual display unit 12. Some examples of mechanisms 14 appear in FIGS. 4*a*-4*d*. In FIG. 4*a*, a spring clip mechanism 38 which attaches display units 12 together is seen. In FIG. 4*b*, an example tongue and groove mechanism 40 is seen. Display units 12 are again shown, with accompanying male end 42 and female receiving end 44. Arrows 46 illustrate a sample direction that display units 12 can take in order to perform the connecting process. For example, material that makes up tongue and groove mechanism 40 may be flexible, allowing female receiving end 44 to expand to receive male end 42 until a secure connection is made. In a related example, mechanism 40 may be rigid, allowing a user to slide male end 42 sideways into female receiving end 44.

Figure 4C:
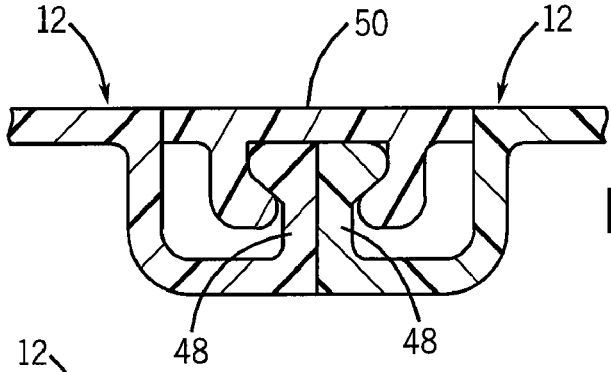
Figure 4D:
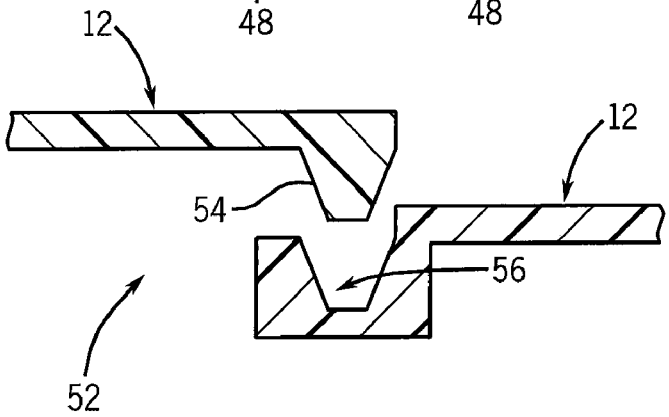

FIG. 4*c* depicts individual display units 12 with associated projecting flaps 48 which are held in place by a snap mechanism 50. Snap mechanism 50 can include either a plastic or spring mechanism to hold display units 12 in place. Finally, FIG. 4*d* shows another sample snap mechanism 52. Mechanism 52 depicts two display units 12. One display unit 12 has a male end 54. A separate display unit 12 has an associated female receiving end 56. The depicted display units 12 snap together and are frictionally held in place.

Figure 5:
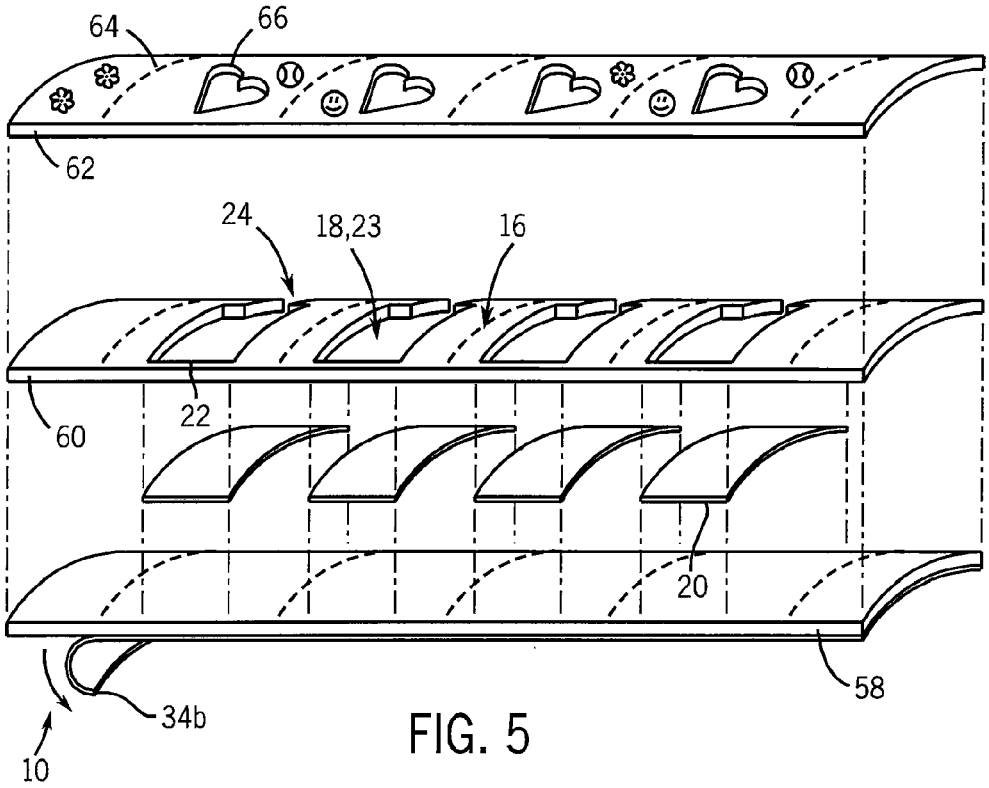
FIG. 5 illustrates a blow-up view of a decorative border.

Turning to FIG. 5, a decorative border example is shown in blown-up format. Border 10 is seen with a flexible sheet of underlayment 58. Underlayment 58 can include a variety of flexible, pliable, stretchable or moldable materials. In one example, underlayment 58 includes a plastic material, such as polyvinylchloride (PVC). Underlayment 58 can provide support and act as a backing material for images 20 that are placed over underlayment 58. Underlayment 58 can include a securing mechanism to hold or anchor images 20 in place. Underlayment 58 includes attachment mechanism 34*b*, which is a peel-away adhesive backing attached to the bottom of underlayment 58 for mounting border 10 to a surface. To use attachment mechanism 34*b*, a user can simply peel away the backing material to expose an adhesive. The user can then attach underlayment 58, and in turn, border 10 to a surface with the adhesive.

Shown positioned over underlayment 58 is a flexible sheet of covering 60. Covering 60, in one example, is disposed over underlayment 58 and forms a pocket 22 and a surrounding decorative surface area 16. Pocket 22 is adapted to receive image 20. Pocket 22 can be enclosed or sealed on all sides except for the top portion of pocket 22, where a slit is formed into the pocket 22 for receiving image 20. Border 10 can include a series of several pockets 22 with associated slits where a user can insert images 20. As an alternative, underlayment 58 can feature a removable cut-out which is intended to allow the placement of an image 20 inside border 10, again similar to an ordinary picture frame. To use pocket 22, a user simply inserts or removes as necessary an image 20 in the respective opening in pocket 22.

Like underlayment 58, covering 60 can include a variety of flexible, pliable, stretchable or moldable materials, such as PVC or other plastic-type materials. In the example shown, pocket 22 has an associated tab 24 which allows a user to grasp and remove an image 60 from a slit in pocket 22 without having to remove a piece of backing material. Pocket 22 has an opening 18 in decorative surface area 16 and an associated covering 23 for protecting the image. Covering 23 can be a clear plastic or glass material. Again, covering 23 can include decorative and ornamental elements designed to enhance or convey a certain effect to the image 20, such as blurriness or additional embedded colors or designs.

Referring again to FIG. 5, a flexible decorative sheet 62 is shown positioned over covering 60. Here, as before, sheet 62 can include a variety of flexible, pliable, stretchable or moldable materials, such as PVC or other plastic-type materials. Sheet 62 can be optionally disposed over covering 60 to provide additional ornamentation to border 10 and associated images 20. Sheet 62 can be removable and/or re-attachable to covering 60. Graphical images can be imprinted on surface area 64. In another example, sheet 62 can have associated cut-outs of various decorative shapes shown here by heart shape 66. Shape 66 is designed to be placed over pocket 22 and image 20 to frame image 20 accordingly. Because underlayment 58 and covering 60 adequately support image 20, sheet 62 can include a variety of sizes, any of which are adapted for securing to covering 60. Sheet 62 can be larger than underlayment 58 and covering 60 in order to conceal the periphery of underlayment 58 and covering 60 and provide a clean look. Sheet 62 can include a plurality of individual "sticker"-type pieces which affix to covering 60 and provide ornamentation. The individual pieces can be cut in the design of a graphical image. The individual pieces can be arranged, affixed accordingly to covering 60, or re-arranged and re-affixed to covering 60.

Underlayment 58, covering 60 and sheet 62 can include a plurality of interconnected individual sheets which are substantially the same size and correspond to an individual display unit 12. The individual sheets can be pre-joined together and include a perforation, so that a user can simply tear apart the number of individual sheets necessary to construct the appropriate length border 10 for a particular application.

The decorative border shown in FIG. 5 can be used in several applications, given its flexibility. Border 10 may be packaged in a pre-configured fashion, in a roll or other similar packaging method. A user may simply unroll border 10, insert images 20, configure the respective attachment mechanism 34*a*, 34*b*, or 34*c* and apply border 10 to a surface.

As described previously, sheet 62 can be designed to be removable and/or re-attachable to covering 60. For example, a user may wish to use sheet 62 with heart shape 66 cutouts during February. In March, however, the user may remove sheet 62 and replace it with a sheet featuring flowers or other artwork as graphical images on surface area 64, or flowers cutouts as shape 66.

Figure 6:
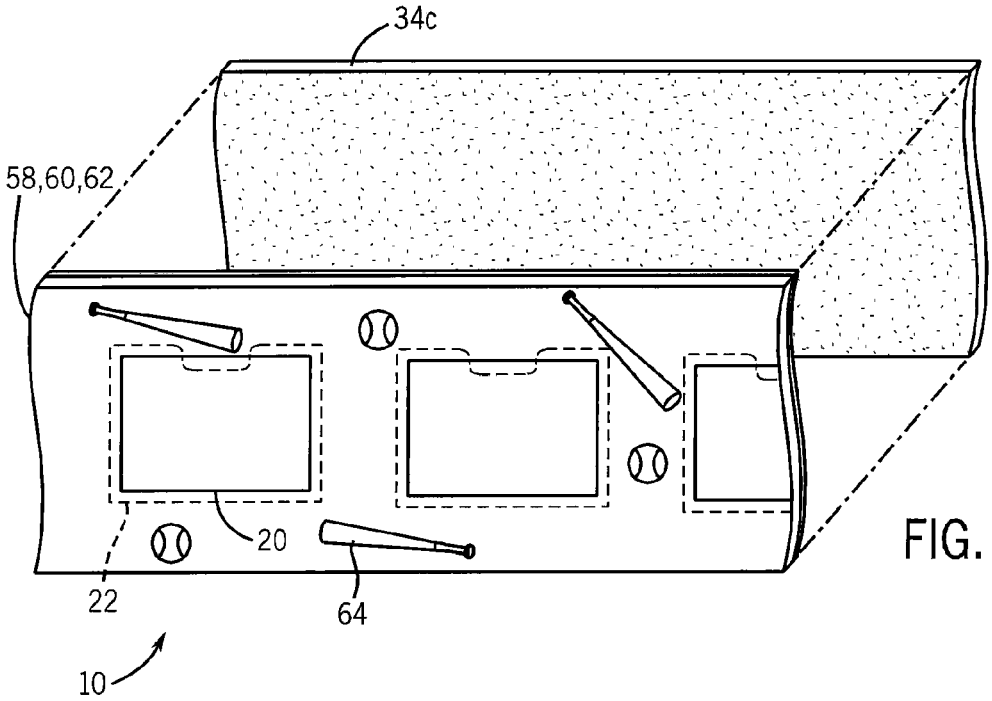
FIG. 6 illustrates an attachment mechanism of a decorative border.

Attachment mechanism 34*a*, 34*b*, or 34*c* can also feature a removable and/or re-attachable mechanism. Turning to FIG. 6, border 10 is again shown, with images 20, pockets 22 and graphical images on surface area 64. Underlayment 58, covering 60 and sheet 62 are seen coupled together. Mechanism 34*c* includes a Velcro backing which can attach to a surface by means of an adhesive and forms a Velcro receiving side. Velcro backing is also applied to the bottom of underlayment 58 to be applied to the Velcro receiving side.

To use mechanism 34*c* as described, a user can attach mechanism 34*c* with associated Velcro receiving side to a surface. The user can then affix border 10 to the Velcro receiving side. The user can remove border 10 from attachment mechanism 34*c* to attach another border, or to insert new images 20 and re-attach border 10 to the same surface.

Border 10 can be used to create a theme for the room or area where border 10 is displayed. A consumer may have a seven-year old daughter who has a particular affinity for Barbie dolls. The consumer may wish to create a Barbie theme room for the daughter. The consumer can purchase sheets, pillowcases, curtains, etc. which are imprinted with Barbie graphics. Instead of purchasing a wallpaper-style border which is imprinted with Barbie graphics, the consumer can elect to purchase border 10 with accompanying sheet 62 and associated surface area 64 featuring Barbie graphics which are imprinted throughout.

Figure 7A:
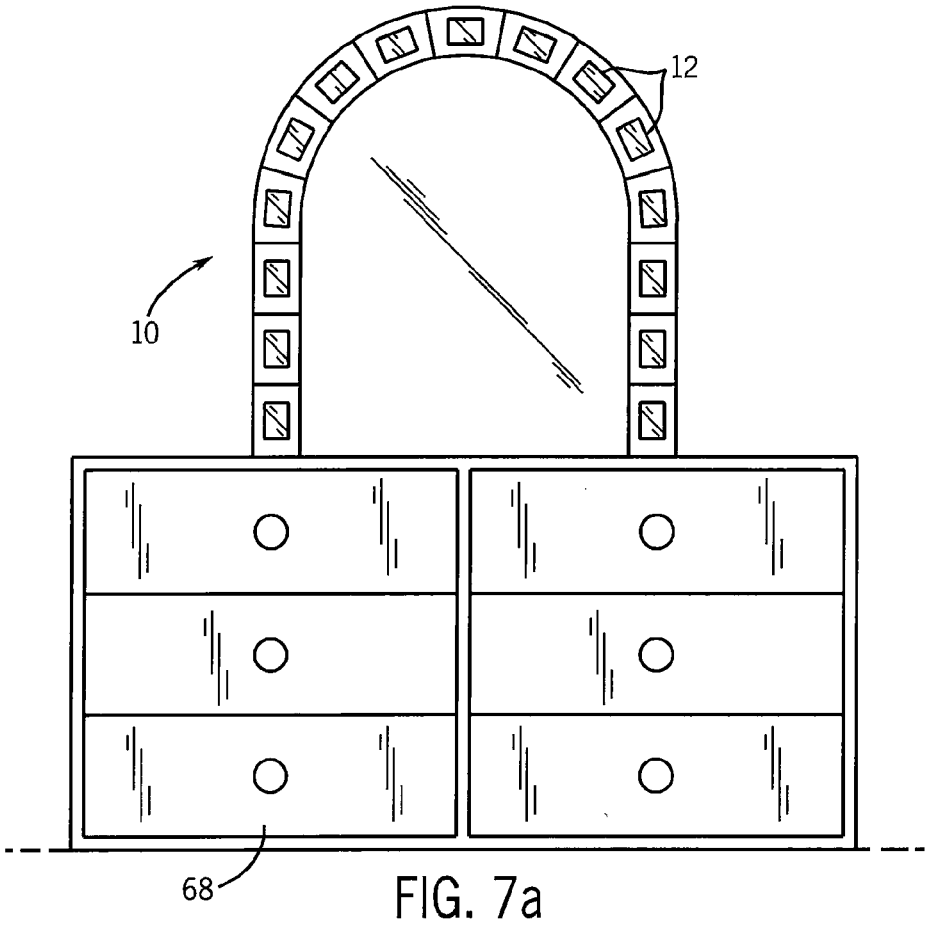
FIGS. 7*a*-7*i* illustrate sample embodiments of a decorative border.
Figure 7B:
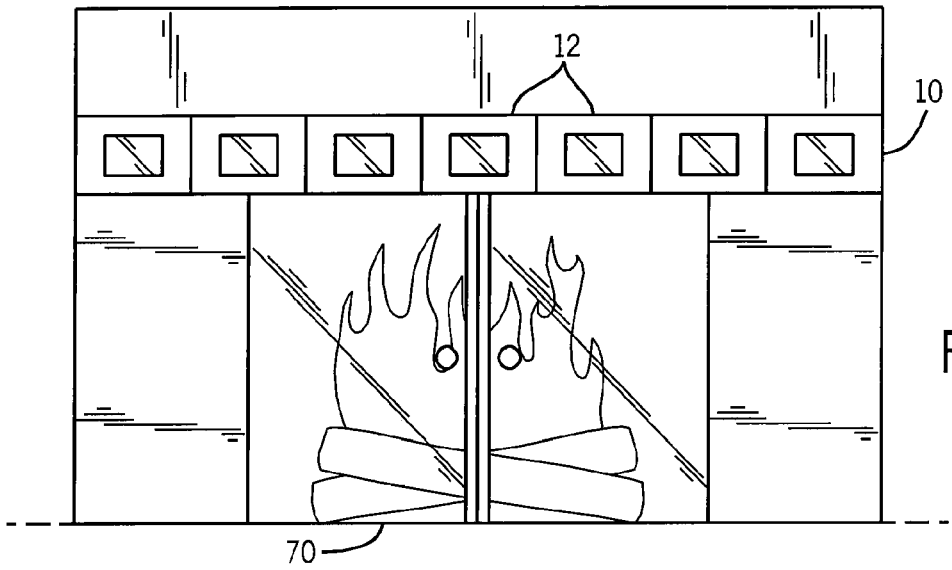
Figure 7C:
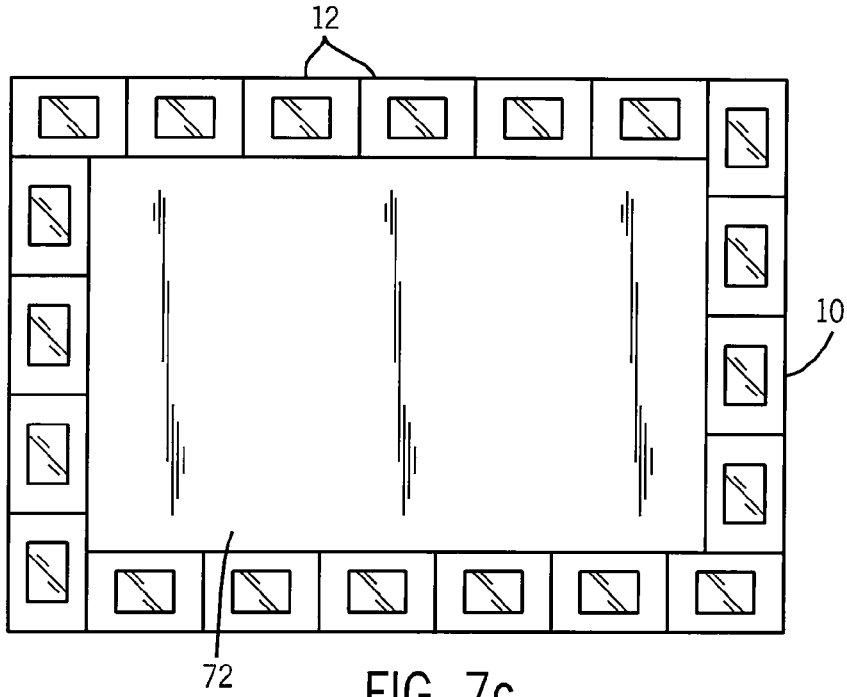
Figure 7D:
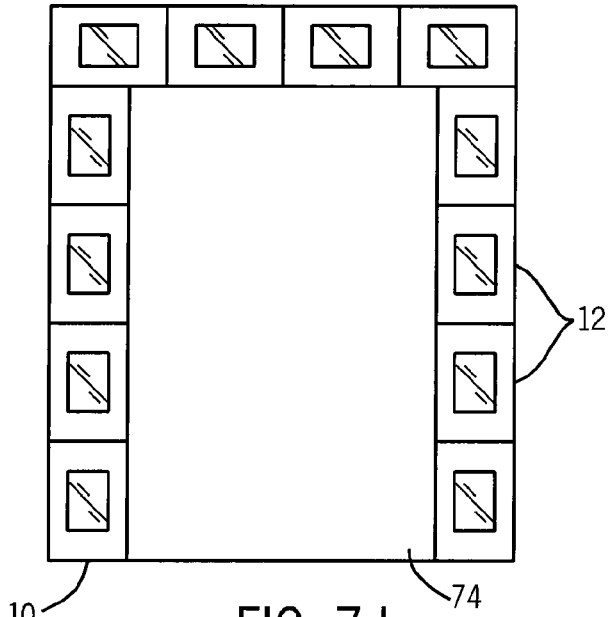
Figure 7E:
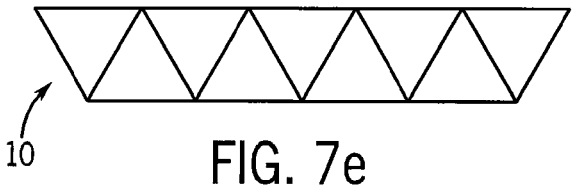

FIGS. 7*a*-7*i* illustrate border 10 in a variety of settings. FIG. 7*a* shows border 10 made up of individual display units 12 surrounding a mirror as part of a vanity 68. FIG. 7*b* depicts border 10 along the edge of a fireplace mantel 70. FIG. 7*c* illustrates border 10 surrounding a bulletin board 72. FIG. 7*d* shows border 10 surrounding a larger image, illustration or artwork 74. FIG. 7*e* shows border 10 as a series of interconnected triangle shapes.

Figure 7F:
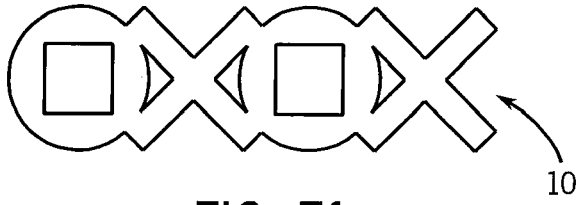
Figure 7G:
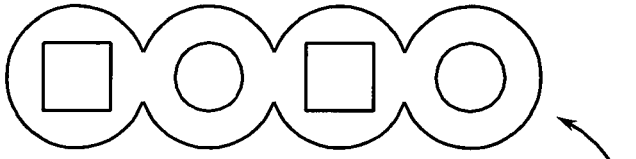
Figure 7H:
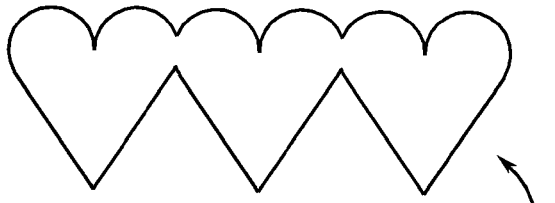
Figure 7I:
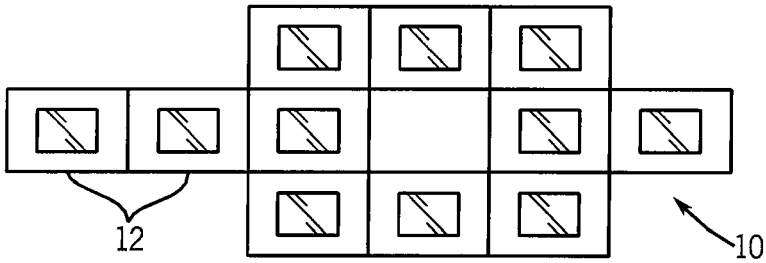

FIG. 7*f* illustrates border 10 as a series of interconnected X's and O's. FIG. 7*g* depicts border 10 as a series of interconnected circle-shaped display units 12. FIG. 7*h* depicts border 10 as a series of interconnected heart-shaped display units 12. Finally, FIG. 7*i* shows border 10 again as a series of interconnected display units 12 which form the depicted pattern.

While one or more embodiments of the present invention have been illustrated in detail, the skilled artisan will appreciate that modifications and adaptations to those embodiments may be made without departing from the scope of the present invention as set forth in the following claims.

What is claimed is:

1. A decorative border, comprising:

ten display units, each having:

a flexible underlayment for supporting the display unit;

a flexible covering removably coupled to the flexible underlayment and having a plurality of openings;

a plurality of display coverings removably coupled to the flexible covering proximate to the plurality of openings and having a substantially transparent material having embedded design features, the design features having blurring or additional colors;

a plurality of photographic display pockets formed by the combination of the plurality of display coverings and the flexible covering;

a plurality of slits formed proximate to an edge of the plurality of photographic display pockets for accepting a graphical document, written document or photograph;

a plurality of tabs coupled proximate to the plurality of slits;

a flexible decorative sheet removably coupled to the flexible covering and having a plurality of cutouts, wherein a surface of the flexible decorative sheet includes graphics, a perimeter of the flexible decorative sheet is greater than a perimeter of the flexible covering, and when the flexible decorative sheet is coupled to the flexible covering the plurality of cutouts reside substantially over the plurality of photographic display pockets, a perimeter of the plurality of cutouts is substantially non-co-extensive with a perimeter of the plurality of photographic display pockets, and the flexible decorative sheet having a substantially planar configuration;

a plurality of sticker pieces removably coupled to the flexible decorative sheet;

a connecting mechanism coupled to each of a top edge, bottom edge, first end and second end of the display unit, the connecting mechanism having flaps;

a snap mechanism configured to couple to a solid surface and having protrusions configured to couple to the flaps; and a plurality of perforation lines formed in each of the flexible underlayment, flexible covering, and flexible decorative sheet, wherein the plurality of perforation lines are formed at substantially corresponding locations on each of the flexible underlayment, flexible covering, and flexible decorative sheet; and wherein a sheet of adhesive material is coupled to the flexible underlayment that substantially covers a rear surface of the flexible underlayment.

2. The decorative border of claim 1, wherein the plurality of cutouts has circle shapes and square shapes.

3. The decorative border of claim 2, wherein the perimeter of flexible decorative sheet has a plurality of heart shapes.

4. A decorative border, comprising:

a flexible underlayment for supporting the decorative border;

an attachment mechanism coupled to the flexible underlayment and having a slot adapted to receive a head of a screw;

a flexible covering coupled to the flexible underlayment and having a substantially transparent material having embedded design features, the embedded design features having blurring or additional colors;

a plurality of photographic display pockets defined by the combination of the flexible underlayment and the flexible covering, the plurality of photographic display pockets each having a slit for providing access to an interior volume of the plurality of photographic display pockets;

a plurality of tabs coupled proximate to the plurality of slits;

a flexible decorative sheet removably coupled to the flexible covering and having a plurality of cutouts, wherein a surface of the flexible decorative sheet includes graphics, a perimeter of the flexible decorative sheet is greater than a perimeter of the flexible covering, and when the flexible decorative sheet is coupled to the flexible covering the plurality of cutouts are configured to reside substantially over the plurality of photographic display pockets, a perimeter of the plurality of cutouts is substantially non-co-extensive with a perimeter of the plurality of photographic display pockets, and the flexible decorative sheet having a substantially planar configuration;

a plurality of sticker pieces removably coupled to the flexible decorative sheet;

a connecting mechanism coupled to each of a top edge, bottom edge, first end and second end of the decorative border, the connecting mechanism having a spring clip;

a plurality of perforation lines formed in the flexible underlayment, flexible covering, and flexible decorative sheet wherein the plurality of perforation lines are formed at substantially corresponding locations on the flexible underlayment, flexible covering, and flexible decorative sheet; and wherein the decorative border is configured to form a roll.

5. The decorative border of claim 4, wherein the plurality of cutouts has circle shapes and square shapes.

6. The decorative border of claim 4, wherein the perimeter of flexible decorative sheet has a plurality of heart shapes.

7. A decorative border, comprising:

a flexible underlayment for supporting the decorative border;

a mounting mechanism coupled to the flexible underlayment and configured to removably couple to a solid surface;

a flexible covering removably coupled to the flexible underlayment and having a plurality of openings;

a plurality of display coverings coupled to the flexible covering proximate to the plurality of openings and having a substantially transparent material having embedded design features, the embedded design features having translucent shapes and opaque shapes;

a flexible decorative sheet removably coupled to the flexible covering and having a plurality of cutouts, wherein a surface of the flexible decorative sheet includes graphics, a perimeter of the flexible decorative sheet is greater than a perimeter of the flexible covering, and when the flexible decorative sheet is coupled to the flexible covering the plurality of cutouts resides substantially over the plurality of display coverings, a perimeter of the plurality of cutouts is substantially non-co-extensive with a perimeter of the plurality of display coverings, and the flexible decorative sheet having a substantially planar configuration;

a plurality of sticker pieces removably coupled to the flexible decorative sheet;

a connecting mechanism coupled to each of a top edge, bottom edge, first end and second end of the decorative border, the connecting mechanism coupled to each of the top edge and bottom edge of the decorative border having a tongue and the connecting mechanism coupled to each of the first end and second end of the decorative border having a groove;

a plurality of perforation lines formed in each of the flexible underlayment, flexible covering, and flexible decorative sheet, wherein the plurality of perforation lines is formed at substantially corresponding locations on each of the flexible underlayment, flexible covering, and flexible decorative sheet; and wherein the decorative border is configured to form a roll.

8. The decorative border of claim 7, wherein the attachment mechanism has a sheet of adhesive material coupled to the flexible underlayment that substantially covers a rear surface of the flexible underlayment.

9. The decorative border of claim 7, further including a plurality of tabs coupled proximate to an edge of the plurality of display coverings.

10. The decorative border of claim 7, wherein the plurality of cutouts has circle shapes and square shapes.

11. The decorative border of claim 7, wherein the perimeter of flexible decorative sheet has a plurality of heart shapes.

* * * * *